US006283616B1

(12) United States Patent
Zoroufy

(10) Patent No.: US 6,283,616 B1
(45) Date of Patent: Sep. 4, 2001

(54) CORNER MOUNTED ILLUMINATOR

(76) Inventor: Aboolhassan Zoroufy, 28 Foxglove Cir., Madison, WI (US) 53717

( * ) Notice: Subject to any disclaimer, the term of this patent is extended or adjusted under 35 U.S.C. 154(b) by 0 days.

(21) Appl. No.: 09/393,513

(22) Filed: Sep. 10, 1999

(51) Int. Cl.[7] ..... F21V 11/00

(52) U.S. Cl. ..... 362/368; 362/362; 362/147; 362/190

(58) Field of Search ..... 362/183, 190, 362/191, 192, 146, 147, 368, 362

(56) References Cited

U.S. PATENT DOCUMENTS

| | | | | |
|---|---|---|---|---|
| 4,255,746 | | 3/1981 | Johnson et al. | 340/577 |
| 4,352,151 | * | 9/1982 | Lewis | 362/368 |
| 4,394,714 | | 7/1983 | Rote | 362/576 |
| 4,425,601 | * | 1/1984 | Donahue | 362/146 |
| 4,668,120 | | 5/1987 | Roberts | 404/12 |
| 4,894,758 | | 1/1990 | O'Toole | 362/147 |
| 4,977,351 | | 12/1990 | Bavaro et al. | 315/87 |
| 5,057,980 | | 10/1991 | Russell | 362/147 |
| 5,122,939 | | 6/1992 | Kazdan et al. | 362/243 |
| 5,149,185 | | 9/1992 | Mandy | 362/20 |
| 5,222,799 | | 6/1993 | Sears et al. | 362/146 |
| 5,297,011 | | 3/1994 | Triunfol | 362/147 |
| 5,343,375 | | 8/1994 | Gross et al. | 362/248 |
| 5,365,145 | | 11/1994 | Fields | 362/86 |
| 5,430,627 | | 7/1995 | Nagano | 315/146 |
| 5,618,100 | * | 4/1997 | Glynn | 362/183 |
| 5,749,643 | | 5/1998 | Porter et al. | 362/146 |
| 5,810,468 | | 9/1998 | Shimada | 362/146 |
| 5,813,468 | | 9/1998 | Borak, Jr. | 166/368 |
| 5,839,816 | | 11/1998 | Varga et al. | 362/153.1 |
| 5,904,017 | | 5/1999 | Glatz et al. | 52/287.1 |

* cited by examiner

*Primary Examiner*—Sandra O'Shea
*Assistant Examiner*—Ismael Negron
(74) *Attorney, Agent, or Firm*—Michael Best & Friedrich LLP; Teresa J. Welch; Jeffrey D. Peterson

(57) ABSTRACT

A corner accentuator or corner mounted illumination for providing illumination from the corner of two walls. The accentuator includes a light-illuminated reflector in the front side of a corner plate. The light has a DC power source that can provide power to the light even in when there is a power outage. The power source can be used in conjunction with a solar collector disposed in the front side of the corner plate which recharges the energy storage device.

18 Claims, 3 Drawing Sheets

CORNER MOUNTED ILLUMINATOR

CROSS-REFERENCE TO RELATED APPLICATIONS

Not applicable.

STATEMENT REGARDING FEERALLY SPONSORED RESEARCH OR DEVELOPMENT

Not applicable.

BACKGROUND OF INVENTION

The present invention relates generally to an apparatus for providing illumination from a corner. More particularly, the present invention provides illumination from an apparatus attached to a corner of two connecting walls, thus providing illumination that defines boundaries of rooms, hallways, stairs and other indoor areas in low light or no light conditions.

The interiors of homes, offices, and other buildings frequently experience low light conditions. Low light or no light conditions in interior areas pose a considerable safety concern, as people moving through such areas can harm themselves through collision or fall.

Low light conditions can be the result of inadequacies in standard fixture lighting or can be due to emergency situations, such as power failure. In dark or dimly lit conditions, standard fixture lighting systems pose a problem in that they are often controlled by switches, that are often difficult to locate to turn on the desired lights. In power failure situations, of course, turning on a light switch does not usually remedy the lighting problem.

A further problem with standard fixture lighting systems is that the light provided by such systems are often inadequate for illuminating various structural features in an interior area, such as stairs and corners. Standard fixture lighting systems are most commonly placed on, or adjacent to, the ceiling of interior areas. The placement of lighting systems in such locations often results in the production of heavy shadows and other such unwanted lighting effects with regards to stairs and corners.

There are, of course, numerous emergency lighting systems currently available or power failure conditions, yet they all contain certain features which are undesirable. The most common emergency lighting system is one which is hardwired into the AC electrical system of a building, and contains a DC power source which is charged by AC electrical power. Such emergency lighting systems use AC power until a time when such power is unavailable. The systems then draw power from their DC source. U.S. Pat. No. 4,977,351 issued to Bavaro et al. and U.S. Pat. No. 5,365, 145 issued to Fields disclose such systems. The drawbacks to these types of systems, include, for example, complex installation requiring the emergency lighting system to be physically hardwired into the AC electrical power source in the building. Professional electricians are often required to install such systems. This makes installation of such systems expensive and time-consuming.

More importantly, most emergency lighting systems are often large and unattractive. The size and design of most systems is a necessary trade off for the functionality of providing enough power (usually though a large battery unit) for a light generating source to emit a bright light within a space. The size of many of these systems makes it difficult to mount them externally in stairs and corners.

Some prior art systems have attempted to specifically respond to the problem of illuminating, e.g., corners, stairs, etc., in low light or no light condition. These lighting systems designed to better illuminate such areas also often have many drawbacks. Such lighting systems are often required to be embedded in walls, stairs, and floors of the building itself so as not to obstruct the walkways of individuals. U.S. Pat. No. 4,394,714 issued to Rote and U.S. Pat. No. 5,813,468 issued to Shimada, both disclose lighting systems for stairs which require the systems be built into the steps themselves. Such lighting systems are difficult and costly to install in an existing set of stairs.

Thus, a need exists for an attractive and effective illumination device for corners which can function independent of AC power, is inexpensive, and is easy to install.

SUMMARY OF THE INVENTION

The present invention provides a corner accentuator or illuminator which is self-illuminating for providing illumination from a corner. The accentuator in accordance with the resent invention is aesthetically pleasing, inexpensive, small, unobtrusive and easy to install. The device is electrically self-contained requiring no external electrical wiring.

The foregoing and other advantages of the present invention are realized in one aspect thereof in a corner accentuator for providing illumination from a corner, comprising a unitary structure configured and dimensioned to fit in a corner. The accentuator includes a corner plate having a front side, a back side, a perimeter edge separating said front and back side, and an aperture therethrough; a reflector having a front reflective side, a back non-reflective side, and a reflector aperture; a light source; and an energy storage device electrically connected to the light source.

The plate is mounted in a corner such that it prevents the buildup of dust in corner areas, which are generally hard to reach with cleaning devices. The perimeter edge of the plate is beveled so that the plate fits easily and snugly into a corner to prevent dust from building up in the corner. The corner plate is mounted in a corner so that the front side of the plate faces the room, and the back side of the plate faces the corner. The reflector is mounted within the aperture in the corner plate so that the front reflective side faces the same outward direction as the front side of the corner plate. The light source is mounted within the reflector aperture such that the light source projects light onto the surface of front reflective side of the reflector. The illumination provided by the light source is concentrated and redirected by the reflector providing a bright source of illumination that alerts an individual of the location of the reflector, and therefore, the location of the corner. The energy storage device is mounted proximate to the back side of the corner plate.

In another aspect of the present invention, the energy storage device is charged by a solar powered collector, e.g., a photovoltaic cell. Such a collector is disposed within the recess aperture in the corner plate and is operatively connected to charge the energy storage device for the purpose of keeping it charged.

In further aspect invention, the corner plate is secured thereby to a corner. In another embodiment, the invention can be secured to a corner by using a fastener, e.g., a nail or a screw, that passes through connection apertures in the plate, or by applying adhesive to the perimeter edge.

In another aspect, the invention provides a lighting system which includes a pair corner accentuators used in tandem. In the system, one of the corner accentuators is mounted on the corner of a wall, a stair and the other in an opposite corner. This provides a bright light source that alerts an individual, in low light conditions, of the perimeter and boundaries of the wall. Such a wall can be the wall of a room, hallway, back of a stair, or the like.

In yet another aspect, the invention provides a method of illuminating and defining the steps of a stairway, which includes the steps of securing to each corner of a step a corner accentuator, the corner accentuator including a corner plate having a front side, a back side, a perimeter edge separating said front and back side, and an aperture therethrough; a reflector having a front reflective side, a back non-reflective side, and a reflector aperture, the reflector being mounted within the first aperture; a light mounted within the reflector aperture; and an energy source proximate the back side of the corner plate, and proximate to and electrically connected to the light.

Other advantages and a fuller appreciation of the specific attributes of this invention will be gained upon examination of the following drawings, detailed description of preferred embodiments, and appended claims. It is expressly understood that the drawings are for the purpose of illustration and description only, and are not intended as a definition of the limits of the invention.

BRIEF DESCRIPTION OF THE DRAWINGS

The preferred exemplary embodiments of the present invention will hereinafter be described in conjunction with the appended drawings wherein like designations refer to elements throughout and in which.

DETAILED DESCRIPTION

Figure 1:
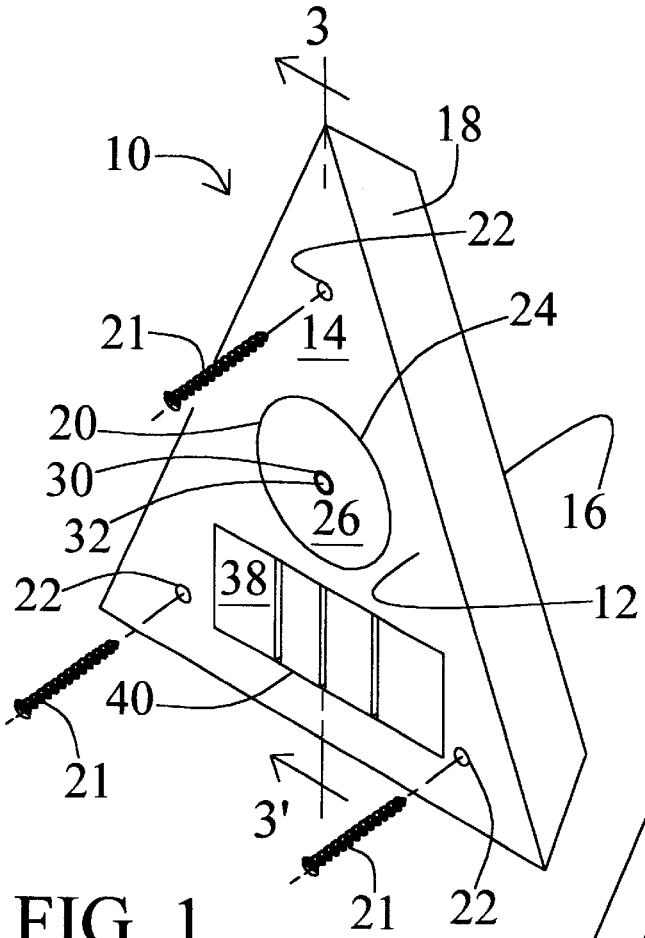
FIG. 1 is a perspective view of the unitary structure in accordance with the present invention.
Figure 2:
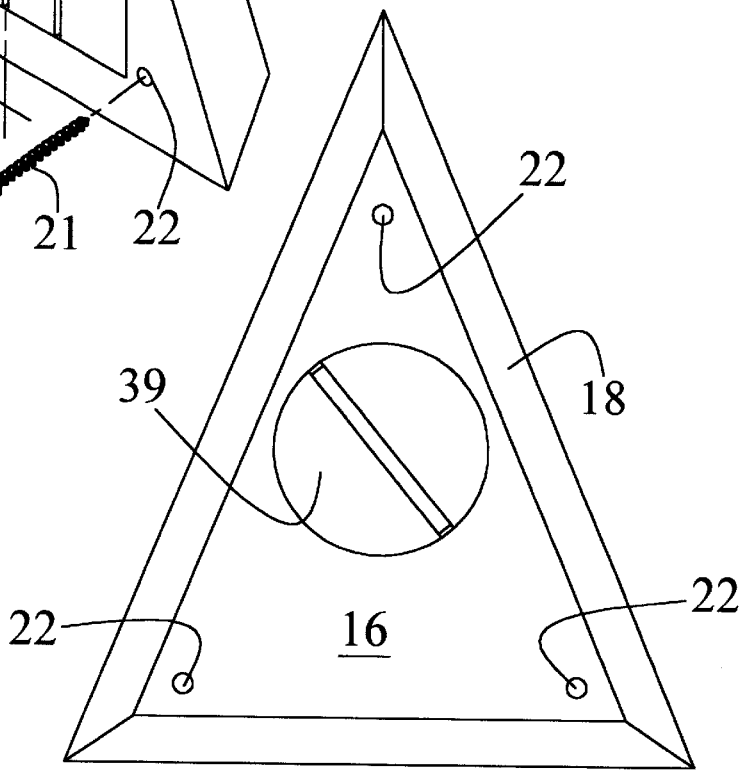
FIG. 2 is a back view of the structure of FIG. 1 in accordance with the present invention.

The present invention relates generally to an apparatus for providing illumination from a corner. The present invention is more particularly adapted for providing dust protection for a corner as well as providing illumination from a solar powered corner accentuator. Accordingly, the present invention will now be described in detail with respect to such endeavors; however, those skilled in the art will appreciate that such a description of the invention is meant to be exemplary only and should not be view as limitative on the full scope thereof In accordance with the present invention, corners are illuminated by a corner accentuator which is positioned in the corner of walls, steps of a stairway, etc. The corner accentuator of the present invention is characterized by several attributes: it is attractive, simple, compact, long-lasting, can function independent of AC power, inexpensive, and is easy to install. These attributes are achieved through a particular structural arrangement meeting special combination of physical parameters.

As used herein, the term "corner" is meant to refer to the vertex of three substantially perpendicular walls, panels or surfaces, and "corner plate" refers to a plate adapted to fit in a corner, typically a triangular-shape plate Reference is initially made to FIGS. 1–4 depicting a corner accentuator 10 in accordance with the present invention. Accentuator 10 has an unitary structure which includes a corner plate 12. Comer plate 12 has a front side 14, a back side 16, a suitably beveled perimeter edge 18, and an aperture 20. The corner plate 12 is preferably made out of a strong sturdy material, that is also attractive. Metal is suitable, preferably brass. Brass can give a polished attractive look to the front side 14 of the corner plate 12, while providing the strength to withstand vibrationally impact by passing foot traffic, especially when used on a step.

The perimeter edge 18 of the corner plate 12 is beveled at such an angle that the plate can fit easily and snugly into a corner. An adhesive, such as two sided tape, or epoxy, may be suitably affixed to the beveled perimeter edge 18 of the corner plate 12 and allow for quick, easy, and effective mounting in a corner. Alternatively, fasteners 20, such as nails or screws, can be used to mount the corner plate 12 into a corner. As such, the corner plate 12 may suitably have a plurality of connection apertures 22 that allow nails or screws to pass through the plate and secure the plate to a corner.

Figure 3:
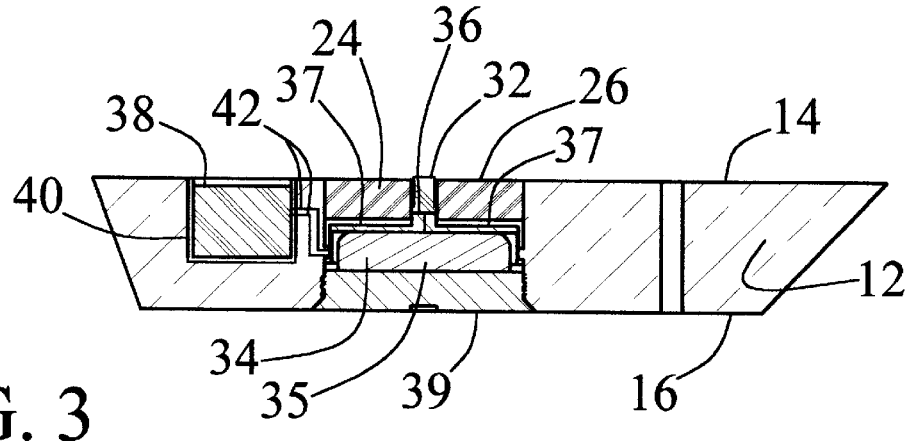
FIG. 3 is a side sectional view of the structure of FIG. 1 along line 3—3'.
Figure 4:
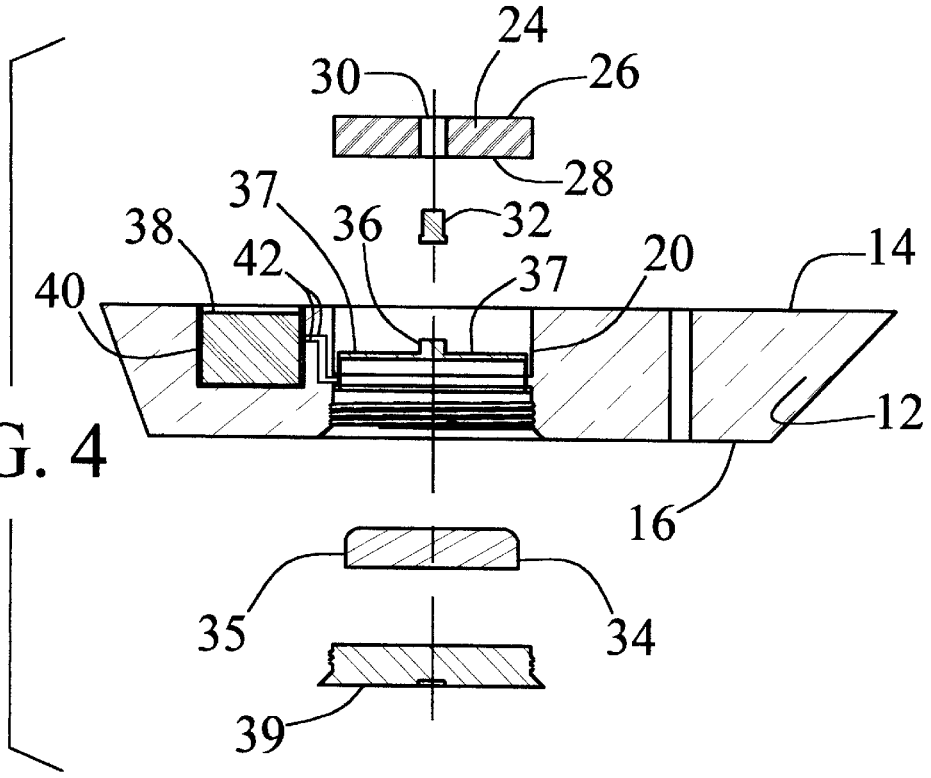
FIG. 4 is an exploded view of FIG. 3.

Referring specifically to FIGS. 3 and 4, aperture 20 in the corner plate 12 provides an area for a reflector 24 to be received therein. The reflector 24 has a front reflective side 26, a back non-reflective side 28, and an aperture 30. Reflector 24 may be produced from any transparent solid. Molded plastic is preferred as it has a high refractive index. Moreover, molded plastic reflectors can be produced at a relatively low cost and are commercially readily available.

The reflector 24 is mounted within aperture 20 of the corner plate 12. It is mounted so that front reflective side 26 faces the same outward direction as front side 14 of the corner plate 12. Reflector 24 is suitably mounted to the corner place by use of an adhesive, e.g., an epoxy adhesive.

Aperture 30 in the reflector 24 provides an area for a light source 32 to be received therein. The light source 32 is mounted within aperture 30 of the reflector 24, preferably by an adhesive, so that light source 32 projects light onto the surface of the front reflective side 26 of the reflector 24. This configuration spreads light over a relatively wide surface of reflector 24, thereby promoting visibility at great distances and at varied angles.

Light source 32 is suitably a low voltage lamp, preferably a high intensity light emitting light emitting diode (LED) that emits optical radiation in the visible regions. Alternatively, an incandescent lamp may be used for light source 32.

Light source 32 is electrically connected to an energy storage device 34. The connection may be made via a contact tab made of a conductive material and designated as 36. The energy storage device 34 is suitably mounted behind light source 32, being held by clips 37. Aperture 20 is provided with a removable cover 39 which is suitably threadedly secured to the back side 16 of corner plate 12 to cover aperture 20. The energy storage device 34 is suitably a battery 35, and preferably, a rechargeable battery, such as a nickel cadmium or lithium battery.

As shown in FIGS. 3 and 4, an alternative arrangement of the invention makes use of a solar collector 38 to charge the energy storage device 34. A recess 40 in the front side 14 of the corner plate 12 provides an area for the solar collector 38 to be received therein. The solar collector 38 is disposed within recess 40 of corner plate 12, and is further connected to the energy storage device 34 by connectors 42 the collector 38 is suitably mounted within recess 40 with e.g. an epoxy.

It is understood that a simple control circuit is suitably employed to illuminate light source 32 and charge battery 35. A schematic diagram of one such circuit is found in U.S. Pat. No. 4,668,120, the disclosure of which is incorporated herein by reference. The circuit shown in U.S. Pat. No. 4,668,120 is merely exemplary and those skilled in the art will recognize that illuminating and recharging may easily be created using a circuit similar to the one shown, or a circuit completely different from this one shown.

Figure 5:
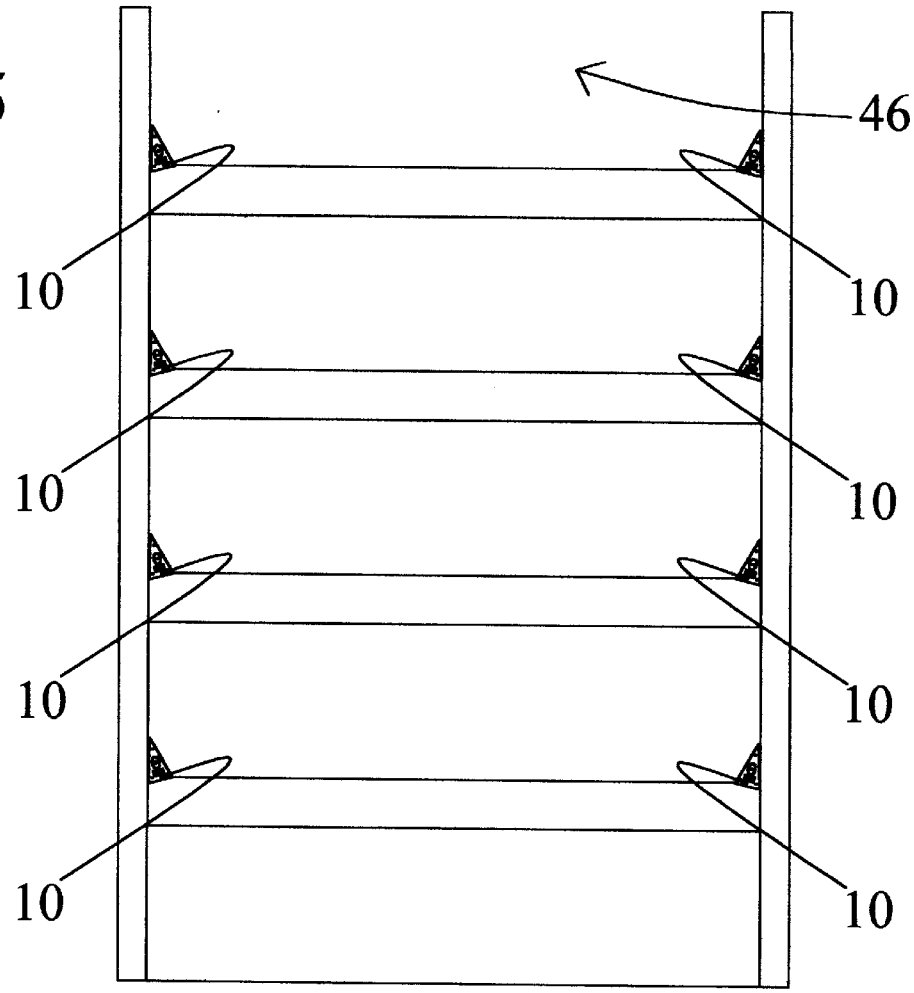
FIG. 5 is a perspective view of the lighting system in accordance with the present invention being utilized in stair case.
Figure 6:
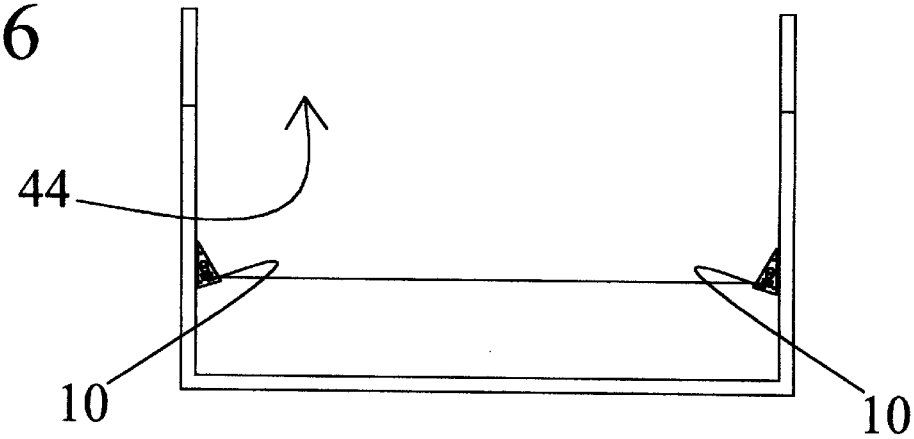
FIG. 6 is a perspective view of the lighting system in accordance with the resent invention being utilized in a hallway.

Referring now to FIGS. 5–6, a perspective view shows a lighting system using a pair of corner accentuators 10 being used in tandem along the same wall. By positioning the accentuators 10 in opposite corners of the same wall, the light provided by the accentuators provide a viable boundary of a wall in low light conditions. Such a wall, might be a wall to a room 44, or a wall defining the back of a stair 46.

While the present invention has now been described and exemplified with some specificity, those skilled in the art will appreciate the various modifications, including variations, additions, and omissions, that may be made in what has been described. Accordingly, it is intended that these modifications also be encompassed by the present invention and that the scope of the present invention be limited solely by the broadest interpretation that lawfully can be accorded the appended claims.

What is claimed is:

1. A corner mounted illuminator for providing illumination from a corner, said illuminator comprising a unitary structure configured and dimensioned to fit in a corner, and said illuminator further comprising:

a. a non-translucent corner plate having a front side, a back side, a perimeter edge separating said front and back side, and a reflector aperture therethrough;

b. a reflector having a front reflective side, a back non-reflective side, and a light source aperture, said reflector being mounted within the reflector aperture to said corner plate;

c. a light source mounted within the light source aperture between the back side and the front side of the corner plate; and d. an energy storage device electrically connected to said light source, and mounted proximate to the back side of said corner plate.

2. The corner mounted illuminator of claim 1 wherein said energy storage device is a rechargeable battery.

3. The corner mounted illuminator of claim 1 wherein said light source is a light emitting diode.

4. The corner mounted illuminator of claim 3 wherein said energy storage device is a rechargeable battery.

5. The corner mounted illuminator of claim 1, further comprising:

a. said corner plate having a solar collector recess in said front side; and b. a solar collector disposed within said solar collector recess, said solar collector operatively connected to charge said energy storage device.

6. The corner mounted illuminator of claim 5 wherein said light source is a light emitting diode.

7. The corner mounted illuminator of claim 5 wherein said energy storage device is a rechargeable battery.

8. The corner mounted illuminator of claim 1 or 5 further comprising attachment means for securing said unitary structure to a corner.

9. The corner mounted illuminator of claim 8 wherein said energy storage device is a rechargeable battery.

10. The corner mounted illuminator of claim 8 wherein said attachment means includes at least one connection aperture through said corner plate for passing a fastener to secure the corner plate to a corner.

11. The corner mounted illuminator of claim 10 wherein said energy storage device is a rechargeable battery.

12. In a wall having opposite corners formed by the vertex of three mutually perpendicular walls, a lighting system comprising a pair of corner mounted illuminators, one of said pair disposed in one corner, and the other of said pair disposed in an opposite corner, said corner mounted illuminator comprising:

a. a non-translucent corner plate having a front side, a back side, a beveled perimeter edge therebetween, and a reflector aperture therethrough;

b. a reflector having a front reflective side, a back non-reflective side, and a light source aperture, said reflector being mounted within the reflector aperture;

c. a light source mounted within the light source aperture between the back side and the front side of the corner plate; and d. an energy storage device proximate said back side of said corner plate, and proximate to and operatively connected to said light source.

13. The lighting system of claim 12 wherein the corner mounted illuminator further comprises:

a. the corner plate having a recess; and b. a solar collector disposed within the recess, said solar collector operatively connected to charge said energy storage device.

14. A corner mounted illuminator, comprising:

a non-translucent triangular plate configured and dimensioned to fit in a corner, and having a front side, a back side, a perimeter edge therebetween, a reflector aperture therethrough and a recess in said front side;

a reflector having a front reflective side, a back non-reflective side, and a light source aperture, said reflector being mounted within the reflector aperture;

a light mounted within the light source aperture between the back side and the front side of the corner plate;

an energy storage device proximate said back side of said triangular plate, and proximate to and electrically connected to said light; and a solar collector disposed within the recess of the triangular plate, said solar collector operatively connected to charge said energy storage device.

15. A corner mounted illuminator, comprising a non-translucent corner plate, a reflector, a light and a DC voltage source;

said corner plate having a front side, a back side, a perimeter edge separating said front and back side, and a reflector aperture;

said reflector having a front reflective side, a back non-reflective side, and a light source aperture, said reflector being mounted within the reflector aperture;

said light mounted within the light source aperture between the back side and the front side of the corner plate; and said DC source proximate said back side of said corner plate, and proximate to and electrically connected to said light source.

16. A method of illuminating and defining the steps of a stairway, comprising:

securing to each corner of a step a corner mounted illuminator; said corner mounted illuminator including:

a non-translucent corner plate having a front side, a back side, a perimeter edge separating said front and back side, and a reflector aperture therethrough;

said reflector having a front reflective side, a back non-reflective side, and a light source aperture, said reflector being mounted within the reflector aperture;

said light mounted within the light source aperture between the back side and the front side of the corner plate; and said energy source proximate said back side of said corner plate, and proximate to and electrically connected to said light.

17. A corner mounted illuminator for providing illumination from a corner, said illuminator comprising a unitary structure configured and dimensioned to fit in a corner, and said illuminator further comprising:

a. a non-translucent corner plate having a front side, a back side, a perimeter edge separating said front and back side, and a reflector recess on the front side;

b. a reflector having a front reflective side, a back non-reflective side, and a light source aperture, said reflector being mounted within the reflector recess to said corner plate;

c. a light source mounted within the light source aperture; and d. an energy storage device electrically connected to said light source, and mounted proximate to the back side of said corner plate.

18. A corner mounted illuminator for providing illumination from a corner, said illuminator comprising a unitary structure configured and dimensioned to fit in a corner, and said illuminator further comprising:

a. a non-translucent corner plate having a front side, a back side, a perimeter edge separating said front and back side, and a reflector recess on the front side;

b. a reflector having a front reflective side, a back non-reflective side, and a light source aperture, said reflector being mounted within the reflector recess to said corner plate;

c. a light source mounted within the light source aperture such that the light source is mounted within said corner plate as opposed to being mounted behind said corner plate; and d. an energy storage device electrically connected to said light source, and mounted proximate to the back side of said corner plate.

* * * * *